US005855134A

United States Patent [19]

Womelsdorf et al.

[11] Patent Number: 5,855,134

[45] Date of Patent: Jan. 5, 1999

[54] WIRE ROLL STAND

[75] Inventors: Friedhelm Womelsdorf, Hilchenbach; Gerhard Pithan; Rüdiger Grimmel, both of Netphen; Karl Keller, Hilchenbach, all of Germany

[73] Assignee: SMS Schloemann-Siemag AG, Düsseldorf, Germany

[21] Appl. No.: 994,168

[22] Filed: Dec. 19, 1997

[30] Foreign Application Priority Data

Dec. 23, 1996 [DE] Germany ..... 196 54 062.3
Dec. 23, 1996 [DE] Germany ..... 296 22 323 U

[51] Int. Cl.[6] ..... B21B 27/00; B21B 31/07

[52] U.S. Cl. ..... 72/201; 72/200; 72/237; 72/240

[58] Field of Search ..... 72/201, 200, 202, 72/236, 39, 40, 43, 237, 240, 248

[56] References Cited

U.S. PATENT DOCUMENTS 4,423,612 1/1984 Uppaluri ..... 72/237
4,630,458 12/1986 Kakabaker ..... 72/201
5,524,469 6/1996 Sherwood ..... 72/248

*Primary Examiner*—Joseph J. Hail, III
*Assistant Examiner*—Rodney Butler
*Attorney, Agent, or Firm*—Friedrich Kueffner

[57] ABSTRACT

A wire roll stand with roll rings mounted in a cantilevered manner onto roll shafts, wherein the roll rings can be axially clamped through spacer rings against an end of the respective roll shaft. The roll shafts are adjustable by eccentric bushings mounted in a housing and the eccentric bushings as well as the roll shafts are sealed relative to walls of the housings. The housing wall through which the roll shafts extend is equipped with openings which take into consideration the adjusting range of the roll shafts, wherein the openings are fixedly lined with sealing rings having a U-shaped profile. The spacer rings have a U-shaped profile and are composed of at least two parts with separating surfaces thereof extending within the profile yokes, wherein the sides of the spacer rings rest on the sides of the sealing rings within the adjusting range. The housing wall through which the roll shafts extend has blind-end bores for supplying pressurized water, wherein the blind-end bores are provided with outlet openings directed toward the sides of the sealing rings facing the roll.

9 Claims, 3 Drawing Sheets

107
108
109
114
116
105
112
115
104
111
103
117
102
106
101
113
117
110
108

WIRE ROLL STAND

BACKGROUND OF THE INVENTION

1. Field of the Invention

The present invention relates to a wire roll stand with roll rings mounted in a cantilevered manner onto roll shafts, wherein the roll rings can be axially clamped through spacer rings against an end of the respective roll shaft, wherein the roll shafts are adjustable by means of eccentric bushings mounted in a housing, and wherein the eccentric bushings as well as the roll shafts are sealed relative to walls of the housings.

2. Description of the Related Art

In addition to the seals for the roll shafts, wire roll stands of the above-described type also have seals for the eccentric bushings. These seals have the purpose of separating the oil-lubricated drive side of the roll shafts from the water-cooled roll side of the roll shaft in such a way that the cooling water which frequently contains sinter cannot reach the oil circulation and oil cannot reach the rolling stock.

However, it has been found that the service life of the seals is not satisfactory because, on the sides of the seals facing the rolls, the water used for cooling the roll frequently contains rolling sinter. The rolling sinter is deposited under the sealing lips of the seals and causes a non-uniform contact pressure and a non-uniform wear, so that the sealing effect is negatively influenced and a premature failure of the seal may occur. When the seals are defective, the sinter contained in the cooling water may reach the oil circulation for the roll shaft and may cause the bearings of the roll shafts to be destroyed. Conversely, the oil may reach the roll rings, so that the quality of the rolling stock may be negatively influenced. In addition, the seals are easily overheated, so that the service life of the seals is significantly reduced.

SUMMARY OF THE INVENTION

Therefore, it is the primary object of the present invention to provide a sealing device for wire roll stands in which the sealing effect is improved and the service life is increased.

In accordance with the present invention, the housing wall through which the roll shafts extend is equipped with openings which take into consideration the adjusting range of the roll shafts, wherein the openings are fixedly lined with sealing rings having a U-shaped profile. The spacer rings have a U-shaped profile and are composed of at least two parts with separating surfaces thereof extending within the profile yokes, wherein the sides of the spacer rings rest on the sides of the sealing rings within the adjusting range. The housing wall through which the roll shafts extend has blind-end bores for supplying pressurized water, wherein the blind-end bores are provided with outlet openings directed toward the sides of the sealing rings facing the roll.

By providing a sealing device composed of the U-shaped spacer rings and the U-shaped sealing rings, the roll shafts as well as the eccentric bushings are sealed. The U-shaped spacer rings, in which the U-shaped sealing rings are sealingly placed, compensate the adjusting movement of the roll shafts. In order to prevent sinter from penetrating to the respective sealing rings, the housing wall is provided with water supply means for sealing water. The outlet openings for the water supply means are aligned relative to the sealing ring side facing the roll, so that the sealing sides of the sealing rings can be pressed in an optimum manner uniformly over the entire circumference against the spacer rings and particularly the emerging sealing water which, reinforced by the centrifugal force from the interior of the sealing device, reaches the outside, prevents the cooling water containing sinter from reaching the sealing lip. In addition, the discharged sealing water flushes solid particles from the sealing area and prevents deposits of particles.

Moreover, the sealing water sprayed into the sealing device serves to cool the sealing rings and the spacer rings, so that a premature wear of the sealing rings due to overheating is prevented.

In accordance with an advantageous feature, the sides of the spacer rings facing the roll have at the inner surfaces of their free ends a projection forming a narrow gap with the housing wall.

The narrow gaps have the effect that the cooling water containing sinter is kept away in an optimum manner from the sealing rings. In addition, with a predetermined gap width, the pressure of the sealing water and, thus, the pressure acting on the sealing lips of the sealing rings, can be easily adjusted. When the sealing rings surround a seal carrier which can be screwed to the housing wall, the sealing rings can be easily replaced by simply removing the seal carrier and by mounting a new seal carrier with the appropriate new sealing rings.

It has been found useful to provide the seal carrier connected to the housing wall with several blind-end bores which are connected to each other and which are provided with outlet openings distributed over the circumference of the seal. This feature has the effect that a pressure of the sealing water which is as uniform as possible can build up over the circumference of the sealing ring, so that the sealing lips of the sealing rings on the sides of the roll are also pressed uniformly over their circumference against the spacer rings.

In accordance with another embodiment of the present invention, the housing wall through which the wall shafts extend are equipped with openings taking into consideration the adjusting range of the roll shafts. The spacer rings have a U-shaped profile and are composed of at least two parts separated by separating surfaces extending within the profile yokes. The spacer rings surround with their profile sides within the adjusting range the housing wall so as to form a narrow gap therebetween. The housing wall through which the roll shafts extend has blind-end bores for supplying pressurized water. The blind-end bores are provided with outlet openings directed toward the spacer ring side facing the roll. Additional bores directed toward the yokes of the spacer rings can be supplied with compressed air.

The sealing device is composed of the spacer rings having the U-shaped profile, wherein the sides of the spacer rings engage portions of the housing wall so as to form gaps which are as narrow as possible. Pressurized water and/or compressed air may be introduced into the gaps, so that, on the one hand, the cooling water containing sinter is displaced by the pressurized water and is prevented from penetrating the sealing area, so that mixing of the oil with the sinter is prevented and, on the other hand, the oil is kept away from the sealing area by the compressed air. As a result, the oil is not contaminated by sinter and significant oil losses, which would have to be replaced, do not occur. Wear cannot occur because the gap seals operate without contact. The service of the seal is substantially increased as compared to sealing devices of the prior art.

In accordance with an advantageous feature, edge beads are provided in the area of the openings in the housing wall facing the roll for reducing the width of the gap toward the sides of the spacer rings facing the roll. The reduced gap width between the pressurized water openings and the compressed air openings resulting from the edge beads produces a better separating effect of the gap on the side of the roll toward the gap of the sealing device on the side of the drive, so that the sealing effect is further increased.

It has been found useful if the gaps formed between the sides of the spacer rings on the side of the drive and the housing wall are narrower than the gaps formed on the side of the roll. This ensures that the air throughput necessary for a certain required air pressure at the end of the gap is not too great.

In order to distribute the compressed air as well as the pressurized water in an optimum manner in the gap, it is proposed that the housing wall has a plurality of blind-end bores which are connected to each other and a plurality of bores which are connected to each other and which are provided with outlet openings and bore openings distributed over the circumference of the spacer rings.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
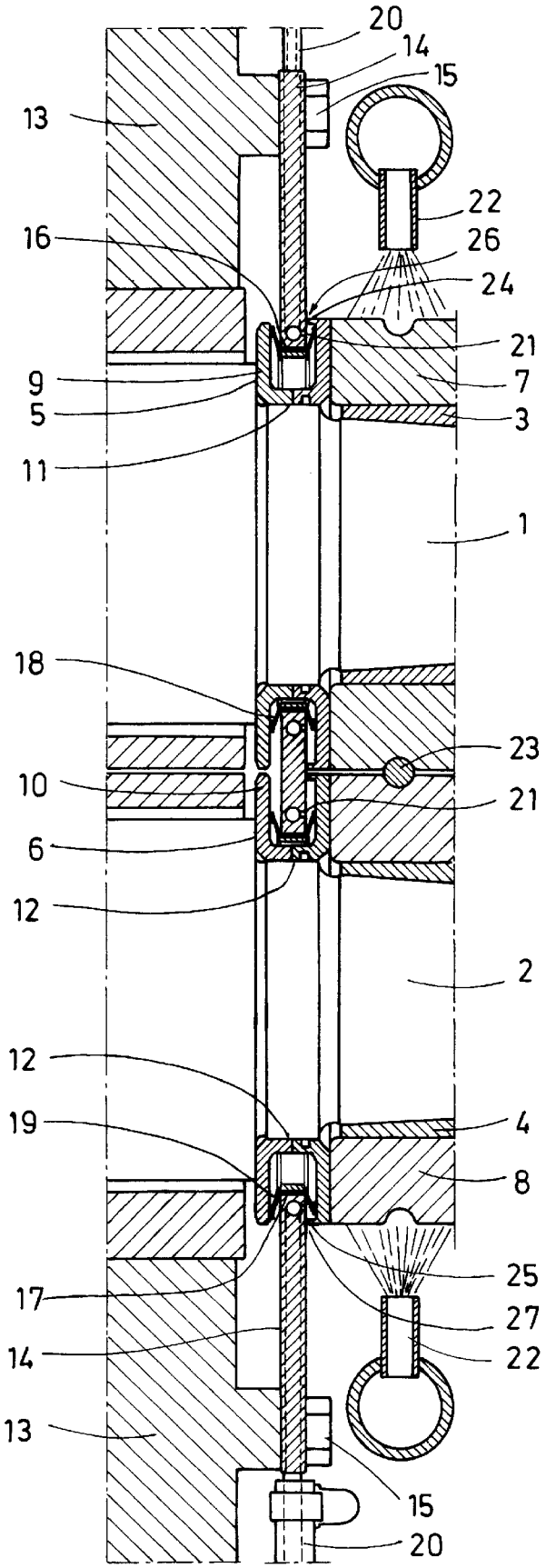
FIG. 1 is a schematic partial sectional view of a first embodiment of the wire roll stand according to the present invention.

FIG. 1 of the drawing shows partially illustrated roll shafts 1,2, wherein spacer rings 3,4 are mounted on the roll shafts 1,2. The spacer ring 3,4 can be clamped axially against the ends 5,6 of the roll shafts 1,2 and support the roll rings 7,8. At their ends resting against the ends 5,6, the spacer rings 3,4 have U-shaped profiles 9,10. The U-shaped profiles 9, 10 are divided into two parts at their profile yokes 11, 12. A seal carrier 14 is fastened by means of screws 15 to the housing 13 of the wire roll stand. The seal carrier 14 has openings whose sizes take into consideration the adjusting range of the roll shafts 1,2. Sealing rings 18, 19 are placed around the edges 16, 17 of the openings, wherein the sealing rings 18, 19 are fixedly connected to the openings. The sealing rings 18, 19 are U-shaped and extend within the U-shaped profiles 9, 10 of the spacer rings 3,4. The profiles 9, 10 are dimensioned in such a way that the sealing lips of the sealing rings 18, 19 rest against the sides of the profiles 9, 10 at any possible adjustment of the roll shafts 1,2.

The seal carrier 14 has blind-end bores 20 which end in the area of the openings and are connected to outlet openings 21 which are directed toward the sealing lips of the sealing rings 18, 19 on the side of the rolls. Through the blind-end bores 20 with the outlet openings 21, the sealing lips of the sealing rings 18, 19 on the side of the rolls can be supplied with sealing water which prevents any cooling water which emerges from the cooling water nozzles 22 and may contain sinter from the rolling stock 23 from penetrating to the sealing rings 18, 19.

The U-shaped profiles 9, 10 have at the ends of their sides facing the rolls a projection 24, 25, wherein each projection 24, 25 forms with the seal carrier 14 a narrow gap 26, 27 which substantially prevents the penetration of cooling water containing sinter and, in combination with the sealing water flow from the gap 26, 27, prevents penetration of the cooling water containing sinter.

Figure 2:
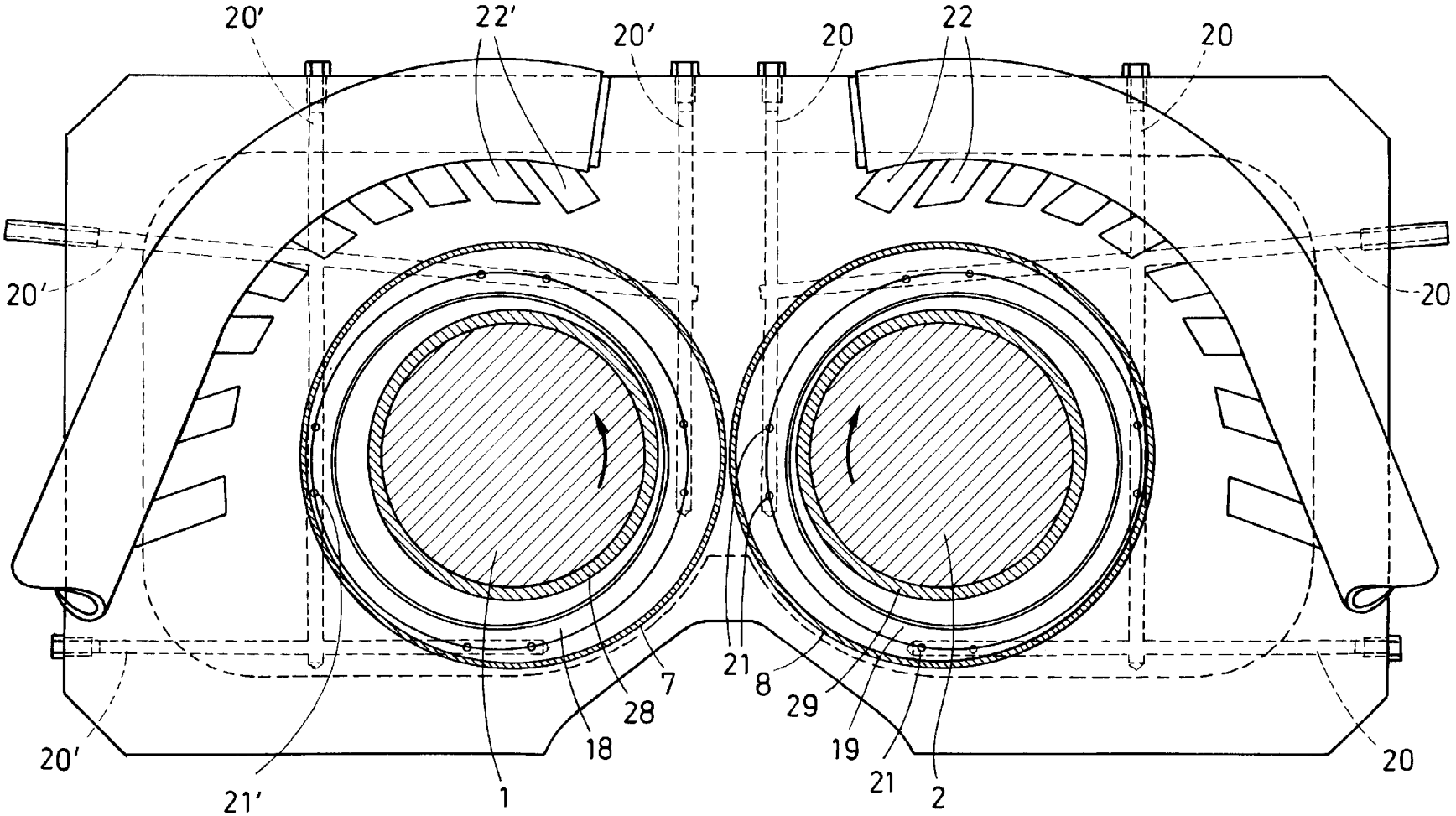
FIG. 2 is a schematic front view, partially in section, of the rolls of the wire roll stand according to the present invention shown in FIG. 1.

The roll shafts 1, 2 which are supported in eccentric bushings 28, 29 can be seen in FIG. 2. Visible in particular are the blind-end bores 20, 20' with their outlet openings 21, 21' in the seal carrier 14. The cooling water nozzles 22 are directed toward the roll rings 7, 8. Also visible are the sealing rings 18, 19 in whose areas the outlet openings 21, 21' are arranged.

Figure 3:
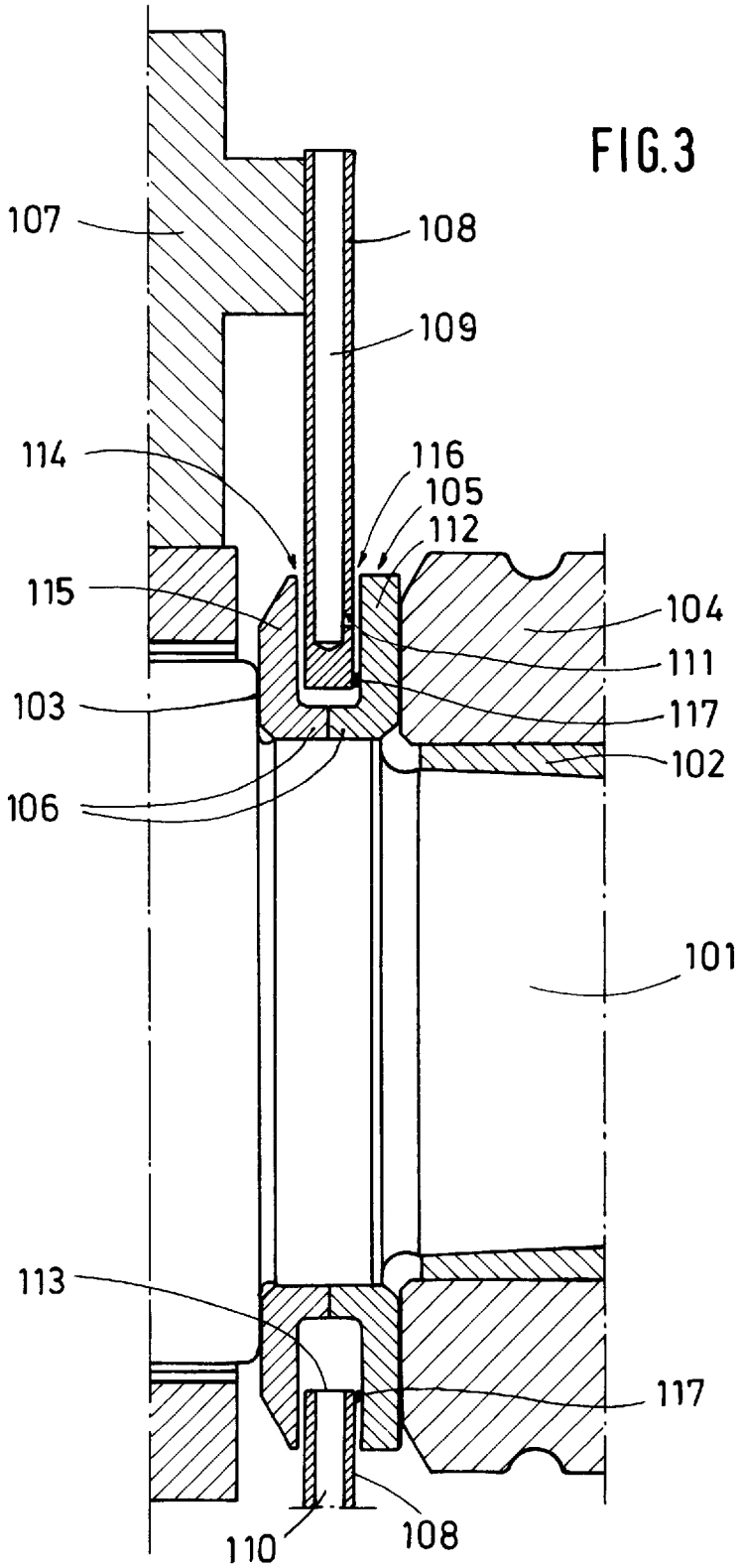
FIG. 3 is a sectional view, on a larger scale, showing the sealing area for one of the two roll shafts of a second embodiment of the wire roll stand according to the present invention.

FIG. 3 of the drawings show a roll shaft 101 on which a spacer ring 102 is arranged. The spacer ring 102 can be clamped axially against an end 103 of the roll shaft 101 and supports the roll ring 104. At its end contacting the side 103, the spacer ring 102 has a U-shaped profile 105. The U-shaped profile 105 is divided into two parts at the profile yoke 106. The housing 107 is provided with a plate 108 which has a cut-out having a size taking into consideration the adjusting range of the roll shaft 101. The plate 108 has blind-end bores 109 distributed over the circumference and directed toward the cut-out, as well as bores 110 which end in the area of the cut-out. The blind-end bores 109 are connected to outlet openings 111, which are directed toward the side 112 of the U-shaped profile 105 facing the rolls. The bore openings 113 of the bores 110 are directed toward the profile yoke 106 of the U-shaped profile 105.

The gap 114 between the plate 108 and the side 115 of the U-shaped profile 105 facing the drive is narrower than the gap 116 between the plate 108 and the side 112. The plate 108 has in the area of its lower end a bead 117 facing toward the side 112, wherein the bead 117 ensures that the gap 116 between the plate 108 and flange 112 is as small as possible.

While specific embodiments of the invention have been shown and described in detail to illustrate the inventive principles, it will be understood that the invention may be embodied otherwise without departing from such principles.

We claim:

1. A wire roll stand comprising roll rings mounted in a cantilevered manner onto roll shafts, the roll shafts having ends, spacer rings for clamping the roll rings axially against an end of each roll shaft, eccentric bushings mounted in a housing for adjusting the roll shafts, wherein the eccentric bushings as well as the roll shafts are sealed relative to walls of the housing, wherein the roll shafts extend through openings of the housing walls, the openings being configured to take into consideration an adjusting range of the roll shafts, sealing rings having U-shaped profiles fixedly lining the openings, wherein the spacer rings have U-shaped profiles, each U-shaped profile being divided into at least two parts at dividing surfaces located in section yokes of the spacer ring, wherein sides of each U-shaped spacer ring contact sides of the sealing rings within the adjusting range, the housing wall further comprising blind-end bores for supplying pressurized water, wherein the blind-end bores have outlet openings directed toward the side of the sealing ring facing the rolls.

2. The wire roll stand according to claim 1, wherein the sides of the U-shaped profiles of the spacer rings facing the rolls have at an inner side of their free ends a projection forming a narrow gap with the housing wall.

3. The wire rolls stand according to claim 1, further comprising a seal carrier screwed to the housing wall, wherein the sealing rings surround the seal carrier.

4. The wire roll stand according to claim 3, wherein the seal carrier has a plurality of additional blind-end bores which ai are in communication with each other, wherein the additional blind-end bores are provided with outlet openings arranged distributed over a circumference of the seal.

5. A wire roll stand comprising roll rings mounted in a cantilevered manner onto roll shafts, the roll shafts having ends, spacer rings for clamping the roll rings axially against an end of each roll shaft, eccentric bushings mounted in a housing for adjusting the roll shafts, wherein the eccentric bushings as well as the roll shafts are sealed relative to walls of the housing, wherein the roll shafts extend through openings of the housing walls, the openings being configured to take into consideration an adjusting range of the roll shafts, wherein the spacer rings have U-shaped profiles, each U-shaped profile being divided into at least two parts at dividing surfaces located in section yokes of the spacer ring, wherein sides of each U-shaped spacer ring surround within the adjusting range the openings of the housing wall so as to form a narrow gap, the housing wall further comprising blind-end bores for supplying pressurized water, wherein the blind-end bores have outlet openings directed toward the side of the sealing ring facing the rolls, further comprising additional bores directed toward the profile yokes of the spacer rings and means for supplying compressed air to the additional bores.

6. The wire roll stand according to claim 5, wherein the openings in the housing wall have edge beads for reducing a width of the gap with the profile sides facing the rolls.

7. The wire roll stand according to claim 5, wherein the gaps between the sides of the spacer rings on a drive side and the housing wall are narrower than the gaps between the housing wall and the sides of the spacer rings facing the rolls.

8. The wire roll stand according to claim 5, wherein the housing wall has a plurality of bores which are in communication with each other, wherein the bores have bore openings arranged distributed over a circumference of the spacer rings.

9. The wire roll stand according to claim 8, wherein the bores are blind-end bores.

* * * * *